US005637172A

United States Patent [19]

Kerr

[11] Patent Number: 5,637,172

[45] Date of Patent: Jun. 10, 1997

[54] METHOD FOR APPLYING A DECAL TO FOAM

[75] Inventor: Rita Kerr, Madera, Calif.

[73] Assignee: Earth & Ocean Sports, Inc., Hyannis, Mass.

[21] Appl. No.: 290,617

[22] Filed: Aug. 15, 1994

[51] Int. Cl.[6] ..... B44C 1/165

[52] U.S. Cl. ..... 156/230; 156/238; 156/323; 156/581; 156/583.1

[58] Field of Search ..... 264/321; 156/64, 156/234, 235, 493, 581, 583.3, 238, 323, 583.1

[56] References Cited

U.S. PATENT DOCUMENTS

| | | | |
|---|---|---|---|
| 3,325,332 | 6/1967 | Cleereman | 156/322 X |
| 3,502,540 | 3/1970 | Pietrocola | 428/203 X |
| 3,562,059 | 2/1971 | Gladen | 264/321 X |
| 3,758,358 | 9/1973 | Kuroda | 156/222 |
| 3,886,126 | 5/1975 | McKenna, Jr. | 260/80.73 |
| 3,887,409 | 6/1975 | McCreary et al. | 264/321 X |
| 3,893,982 | 7/1975 | Gardner et al. | 260/78.5 R |
| 3,894,167 | 7/1975 | Kluge et al. | 156/240 X |
| 3,900,610 | 8/1975 | McKenna, Jr. | 427/207 |
| 3,903,057 | 9/1975 | Gardner et al. | 260/78.5 T |
| 3,931,087 | 1/1976 | Baatz et al. | 260/29.6 SQ |
| 3,931,444 | 1/1976 | McKenna et al. | 428/355 |
| 4,010,880 | 3/1977 | Guillot-Munoz . | |
| 4,012,560 | 3/1977 | Baatz et al. | 428/474 |
| 4,036,675 | 7/1977 | Amberg et al. | 264/321 X |
| 4,302,489 | 11/1981 | Hattori et al. . | |
| 4,322,467 | 3/1982 | Heimbach et al. | 156/240 X |
| 4,329,386 | 5/1982 | Samowich | 428/196 X |
| 4,369,082 | 1/1983 | Kerwin | 156/238 |
| 4,409,275 | 10/1983 | Samowich | 428/138 |
| 4,457,729 | 7/1984 | Peerlkamp | 441/74 |
| 4,478,660 | 10/1984 | Landler et al. | 156/222 X |
| 4,541,885 | 9/1985 | Caudill, Jr. | 264/321 X |
| 4,692,199 | 9/1987 | Kozlowski et al | 264/321 X |
| 4,713,128 | 12/1987 | Kerwin | 156/64 |
| 4,713,412 | 12/1987 | Czerepinski | 260/80.73 |
| 4,850,913 | 7/1989 | Szabao, Jr. | 441/65 |
| 5,124,422 | 6/1992 | Rance et al. | 526/318.2 |
| 5,142,722 | 9/1992 | Kolb | 8/471 |
| 5,211,792 | 5/1993 | Carter | 156/222 X |
| 5,300,170 | 4/1994 | Donohoe | 156/235 |

*Primary Examiner*—David A. Simmons
*Assistant Examiner*—Paul M. Rivard
*Attorney, Agent, or Firm*—Dickinson, Wright, Moon, Van Dusen & Freeman

[57] ABSTRACT

A method for applying a decal or graphic design to a foam substrate is provided. A decal or graphic design comprising polyethylene is provided on a web of carrier paper that is collected on a spool. The web is drawn through a hot stamp press equipped with a crowned silicone head that is heated to about 375° F. The head presses the web to the substrate with a pressure of about 20 psi and a dwell of about 7 seconds, after which the web is removed from the substrate and is automatically advanced to the proper position for the next decal or graphic design to be applied.

16 Claims, 1 Drawing Sheet

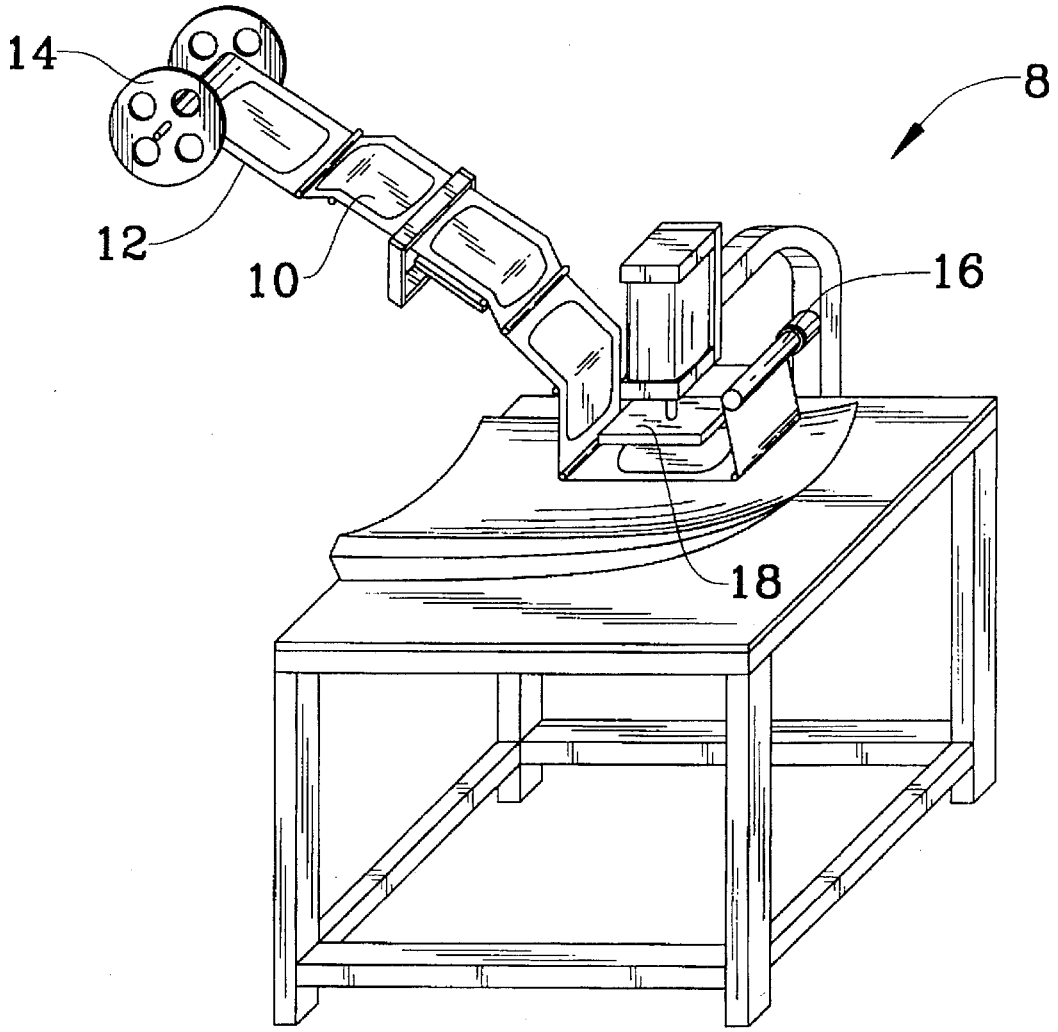
14
8
12
10
16
18

METHOD FOR APPLYING A DECAL TO FOAM

TECHNICAL FIELD

This invention relates generally to the art of decals, and in particular to a new, improved method for applying a decal to a foam substrate.

BACKGROUND

Various presses and other equipment used for applying decals to substrates are known to the prior art. Some prior art equipment relies on silicone pads for pressing the decal to the substrate. For example, U.S. Pat. No. 5,300,170 (Donohoe) describes the use of a presshead in conjunction with a thin membrane of silicone rubber to apply a decal from a piece of carrier paper onto a substrate. As the presshead is lowered against the membrane, the membrane is deformed and pressed into contact with the decal. The dwell time of the presshead is set at a predetermined interval, after which the presshead is retracted and the membrane layer regains its shape, thus lifting the design layer away from its paper backing. The spent paper is then removed preparatory to another cycle. U.S. Pat. No. 5,142,722 (Kolb) describes the use of a silicon pad attached to a platen to attach a decal to furniture.

Many types of prior art equipment that apply decals to a substrate utilize decals that are mounted on a web of carrier paper. Thus, for example, U.S. Pat. No. 4,713,128 (Kerwin) and U.S. Pat. No. 4,369,082 (Kerwin) describe an apparatus for applying decals to articles. The decals are supplied on a web of carrier material. The machine consists of a supply spindle, a takeup spindle and a drive for moving the web from the supply spindle to the takeup spindle. A movable head presses the web and the decal against the surface to which the decal is to be applied. The machine is also provided with a brake and a sensor. The sensor activates the brake when the head is moving into position to press the decal to the surface, and releases it after the decal is applied to the surface.

Various methods are also known to the prior art for applying a decorative plastic film to a substrate. However, these methods have proven unsatisfactory to date for applying a decal to a foam substrate. For example, U.S. Pat. No. 4,409,275 (Samowich) and U.S. Pat. No. 4,329,386 (Samowich) describe a method whereby a decorative acrylic film is laminated to an acrylic foam. In a mass production situation, the acrylic film may be provided in rolls on silicon-coated release paper. The acrylic film is prepared by coating a lithograph with several coatings of a transfer emulsion which is allowed to dry. Next, the emulsion coated lithograph is soaked in water and allowed to dry. The acrylic film bearing the lithographic inks transferred from the lithograph is peeled off the soaked paper, and the ink side of the film is placed into contact with a foam substrate. A hot electric iron is then used to bond the film and foam together, simultaneously crushing the foam. The reference also notes that the foam may be crushed even further to provide crosslinking between the film and the foam.

While methods of this type may be suitable for some purposes, the bond achieved between the acrylic film and the foam substrate is not strong, and the film is therefore prone to peeling. Furthermore, it is undesirable when applying a decal to a finished article to have to crush the article in the vicinity of the decal in order to promote greater adhesion between the decal and the surface of the article. Finally, the aqueous immersion required by this type of method is messy and unsuitable for large scale processes.

It is thus an object of this invention to provide a solvent free method of applying a decal to a foam substrate.

It is a further object to provide a method for applying decals to foam substrates in which a strong bond is achieved between the decal and the substrate without having to physically modify the substrate.

In some prior art methods, the decal is provided on a film of plastic, such as Mylar, which is coated on one side with an adhesive. The film is then applied to a substrate by wetting or melting the adhesive and pressing the adhesive coated side of the film against the substrate. However, decals applied by this method tend to peel away from the substrate when they are exposed to moisture and shearing stresses. A further problem is that many of the films, such as Mylar, that have been used in methods of this type have poor abrasion resistance, and thus wear too quickly.

It is thus an object of this invention to provide a method for applying decals to a foam substrate in which the decal becomes one with the substrate, and is therefore resistant to peeling.

It is a further object of the present invention to provide a method for applying a decal to a foam substrate in which the resulting decal is resistant to abrasion.

Several prior art methods for securing foam articles and decals to the surface of a substrate rely on adhesives. U.S. Pat. No. 5,124,422, U.S. Pat. No. 4,713,412 (Czerepinski, et al.), U.S. Pat. No. 4,012,560, U.S. Pat. No. 3,931,444, U.S. Pat. No. 3,931,087, U.S. Pat. No. 3,903,057, U.S. Pat. No. 3,900,610, U.S. Pat. No. 3,893,982 and U.S. Pat. No. 3,886,126 are exemplary. However, the use of an adhesive for securing a decal to a foam surface has proven unsatisfactory, particularly in aqueous environments, and frequently results in peeling. Furthermore, most adhesives form only a weak bond between the decal and the foam surface.

It is thus an object of this invention to provide a method for applying a decal to a foam substrate that does not rely on adhesives.

These objects as set out above are achieved by the method of the present invention. Other advantages of the present invention will be apparent to those skilled in the art.

SUMMARY OF THE INVENTION

The present invention is an improved method for applying a decal or graphic design to a foam substrate. The decal or graphic design is provided on a polyethylene film which is applied to the substrate through the use of a hot stamp press equipped with a crowned silicone head that is heated to about 375° F. The head presses a web bearing the decal or graphic design to the substrate with a pressure of about 20 psi and a dwell of about 7 seconds, after which web is removed and the decal or graphic design is permanently affixed to the substrate. The shape of the head effectively removes air bubbles from the decal, and provides a better aesthetic effect.

BRIEF DESCRIPTION OF THE DRAWING

The FIGURE is an elevated view of the hot stamp press used in applying a decal or graphic design to a foam substrate.

DETAILED DESCRIPTION OF THE PREFERRED EMBODIMENT

The method of the present invention is particularly suitable for use with foamed substrates, including those comprising polyester, polyurethane, styrene, High Density Polyethylene (HDPE), and Low Density Polyethylene (LDPE). Pursuant to the method, decals or graphic designs may be applied to a foam surface that is later incorporated into finished or unfinished articles, or they may be applied directly to the surfaces of assembled articles. One particular use for the method of the present invention is the application of decals or graphic designs to the surfaces of surf boards, bodyboards, and similar floatable devices.

While prior art decals, such as conventional adhesive decals, are subject to peeling over a short period of time when they are applied to a foam substrate, the decals of the present invention are permanently laminated to the substrate, and actually become a part of the substrate. Therefore, the decals of the present invention last much longer than conventional decals.

The decals are applied in a lamination process that utilizes an automated hot stamp press 8 of the type shown in the Figure. The decals 10 of the present invention, which may include any type of graphic design, are preferably made out of low density polyethylene, and are mounted on a web of silicon carrier paper The web is wound on a supply spool 14 in such a way that the decal will be on the side of the paper facing the substrate as the web is withdrawn from the supply spool. A motorized retracting spool 16 withdraws the web from the supply spool, draws it through the hot stamp press, and rotatably collects the web as it exits the press.

The press is provided with a heated silicone rubber head which is maintained at about 375° F. As the web is drawn beneath the head, the head stamps the decal to the substrate, preferably using a pressure of about 20 psi and a 7 second dwell. While other pressures and dwell times may also produce favorable results, it is preferred that the pressure is sufficiently small to avoid permanent compression of the foam substrate.

The head of the press has a slight curvature so that the central portion of the head impinges on the decal before the outer fringes of the head. This has the benefit of forcing air bubbles out of the decal, thereby resulting in a better aesthetic effect and a stronger bond between the decal and the substrate. The press is provided with braking and timing mechanisms, as are known to the art, which arrest the movement of the web while the decal is being applied, and restart it thereafter.

After the decal has been stamped to the substrate, the head is retracted, and the retracting spool automatically withdraws the web of carrier paper so that the next decal is positioned for application to the substrate. Immediately after the stamping operation is completed, the decal is permanently bound to the substrate.

The above disclosure is intended only to convey an understanding of the present invention to those skilled in the art, and is not intended to be limiting. It will be appreciated that various modifications to the disclosed embodiments are possible without departing from the scope of the invention. Therefore, the scope of the present invention should be construed solely by reference to the appended claims.

I claim:

1. A method for applying a decal to a foam sports board comprising the steps of:

providing a foam sports board;

providing a hot stamp press equipped with a slightly curved heated silicone head;

providing a substantially continuous web of silicone carrier paper having a plurality of decals thereon;

positioning said board and said web beneath said head;

applying pressure with said head to said web thereby forcing said decal against said board;

integrally bonding said board and said decal;

withdrawing said head; and indexing said web forward to position succeeding decal under said head.

2. The method of claim 1, wherein said sports board is a bodyboard.

3. The method of claim 1, wherein said sports board is a surfboard.

4. The method of claim 1, wherein said head is maintained at a temperature of about 375° F.

5. The method of claim 4, wherein said applied pressure is about 20 psi.

6. The method of claim 1, wherein the head presses the web against the substrate with a dwell of about 7 seconds.

7. The method of claim 1, wherein the decal comprises low density polyethylene.

8. The method of claim 1, wherein the foam sports board comprises a material selected from the group consisting of:

polyester, polyurethane, styrene, low density, polyethylene, and high density polyethylene.

9. The method of claim 1, wherein the decal comprises polyethylene.

10. A method for integrally bonding a decal to a recreational article, comprising the steps of:

providing a foam recreational article;

providing a hot stamp press equipped with a slightly curved heated silicone head;

providing a substantially continuous web of silicone carrier paper having a plurality of polyethylene decals thereon;

positioning said article and said web beneath said head;

advancing said head against said web thereby forcing said decal against said article to integrally bond said article and said decal;

withdrawing said head; and indexing said web forward to position succeeding decal under said head.

11. The method of claim 10, wherein said recreational article is a bodyboard.

12. The method of claim 10, wherein said recreational article is a surfboard.

13. The method of claim 10, wherein the recreational article comprises a material selected from the group consisting of:

polyester, polyurethane, styrene, low density, polyethylene, and high density polyethylene.

14. The method of claim 10, wherein said head is maintained at a temperature of about 375° F.

15. The method of claim 10, wherein said applied force is about 20 psi.

16. A method for applying a decal to a recreational article, comprising the steps of:

providing a polyethylene foam recreational article;

providing a hot stamp press equipped with a slightly curved heated silicone head;

providing a substantially continuous web of silicone carrier having a plurality of polyethylene decals thereon;

positioning said article and said web beneath said head;

advancing said head against said web thereby forcing said decal against said article with about 20 psi force and wherein said head is maintained at a tempreature of about 375° F. integrally bond said article and said decal;

withdrawing said head after about 7 seconds; and indexing said web forward to position succeeding decal under said head.

* * * * *